US005908234A

United States Patent [19]

Kreeft

[11] Patent Number: 5,908,234

[45] Date of Patent: Jun. 1, 1999

[54] LUMINAIRE HAVING A SYNTHETIC RESIN COVER

[75] Inventor: Hendrik K. Kreeft, Winterswijk, Netherlands

[73] Assignee: U.S. Philips Corporation, New York, N.Y.

[21] Appl. No.: 08/795,157

[22] Filed: Feb. 7, 1997

[30] Foreign Application Priority Data

Feb. 8, 1996 [EP] European Pat. Off. ..... 96200279

[51] Int. Cl.[6] ..... F21S 3/00

[52] U.S. Cl. ..... 362/223; 362/290; 362/342; 362/375

[58] Field of Search ..... 362/223, 210, 362/290, 298, 317, 325, 341, 342, 346, 455, 456, 374, 375; 359/884

[56] References Cited

U.S. PATENT DOCUMENTS

| | | | |
|---|---|---|---|
| 4,262,327 | 4/1981 | Kovacik et al. | 362/223 |
| 4,494,175 | 1/1985 | Gawad et al. | 362/150 |
| 5,101,331 | 3/1992 | Katoh et al. | 362/256 |
| 5,144,539 | 9/1992 | Katoh et al. | 362/256 |
| 5,186,537 | 2/1993 | Katoh et al. | 362/347 |
| 5,510,965 | 4/1996 | Teakell | 362/223 |

FOREIGN PATENT DOCUMENTS

| | | |
|---|---|---|
| 0435394A1 | 7/1991 | European Pat. Off. . |
| 0435394B1 | 7/1991 | European Pat. Off. . |
| 0609482 | 8/1994 | European Pat. Off. . |
| 1764963 | 9/1968 | Germany . |

*Primary Examiner*—Stephen Husar
*Attorney, Agent, or Firm*—F. Brice Faller

[57] ABSTRACT

The luminaire has a housing (1) with a light emission window (2), and side reflectors (5) and lamellae (7), which may constitute a louver (8), in the housing (1). The light emission plane (2) is closed during transport by means of a shaped plastic sheet (10), which has a base plane (11) and opposed walls (12) connected thereto. The shaped plastic sheet (10) enters the housing with its walls (12) and thereby keeps its position fixed. The shaped sheet (10) can easily be removed when there is no longer a risk of the louver (8) becoming polluted.

5 Claims, 2 Drawing Sheets

LUMINAIRE HAVING A SYNTHETIC RESIN COVER

BACKGROUND OF THE INVENTION

The invention relates to a luminaire provided with:

a housing with a light emission plane;

means for accommodating a tubular lamp in the housing along the light emission plane;

a pair of mutually facing side reflectors in the housing, each having an outer edge in the light emission plane;

a plurality of lamellae arranged transversely between the side reflectors and transversely to the light emission plane.

Such a luminaire is known from EP-B-0 435 394.

It is an advantage of a luminaire of the known kind that it has a comparatively high efficiency because the light emission plane is substantially open, and the light generated by an accommodated lamp is distributed over the field to be illuminated by the side reflectors and the lamellae. Light is lost owing to reflections and absorption in a luminaire whose light emission plane is closed with a prismatic or frosted pane in order to distribute the light.

It is a disadvantage of the known luminaire, however, that the reflectors and the lamellae may become polluted by loose dust particles during transport and, when used in a new building project, during building work after being mounted. Not only does this detract from the appearance of the luminaire, it also reduces the efficiency of the luminaire.

SUMMARY OF THE INVENTION

It is an object of the invention to provide a luminaire in which the risk of early pollution is counteracted.

According to the invention, a shaped synthetic resin sheet having a base surface and a pair of mutually opposed raised walls substantially closes off the light emission plane with its base surface while projecting with its raised walls into the interior of the housing and keeping itself fixed there.

The sheet may remain in place until the pollution risk has been reduced or eliminated. It is favorable when the sheet is at least substantially transparent and also colorless. The luminaire provided with the sheet may then be used for illuminating the space in which it was installed with comparatively low light losses. It is advantageous here that the shaped sheet keeps itself in place and that no additional means, such as glue or tape, are necessary for this.

The sheet may be readily removed whenever desired by simply pulling it off the luminaire. It is advantageous in that case to grip the sheet by an edge between the raised walls.

The raised walls of the shaped sheet may each have a bent edge which bears on the housing with clamping force. The sheet may be provided simultaneously with the side reflectors, if the latter form a detachable louver with the lamellae, or may be provided separately.

The lamellae and the side reflectors may have a paint layer as a finish, or they may be bright and reflecting, for example through the use of mirroring metal layers or anodized aluminum. Mirroring parts have the advantage of a high reflectivity and accordingly a high efficiency, but they do involve the risk of visible fingerprints being left thereon which are difficult or even impossible to remove.

In a favorable embodiment, the side reflectors and the lamellae form a detachable louver which is coupled to the housing by retaining means, and the shaped foil is in engagement with the louver by means of its raised walls while keeping the retaining means accessible. The louver may then be removed from the housing together with the protection in the form of the shaped foil for the purpose of mounting the housing and subsequently be provided again together with the foil.

It is favorable when a rim bent back into the housing is present at each outer edge of the side reflectors, and the raised walls each have an edge folded inwards which hooks around a corresponding rim. The bent edge may be folded, for example, into a V-shape. The edge is reinforced thereby.

The foil may be provided, by passing it over the side reflectors in longitudinal direction. It is advantageous, however, when the raised walls of the foil each have an edge flanged inwards into a rounded shape and hooking around a corresponding rim. The foil may then be readily snapped around the side reflectors. In that case the foil may be present around the side reflectors with clamping force, the rounded edge ensuring that the foil does not detach itself from the side reflectors. It is alternatively possible for the edge to be rounded through an angle of, for example, 360±20°.

The shaped sheet may be made, for example, from a thermoplastic synthetic resin, for example polyvinyl chloride, polyethylene terephthalate, polyester, etc.

The sheet is usually approximately 0.10–0.20 mm thick.

The luminaire may be a single luminaire suitable for accommodating only a single tubular, linear or U-shaped lamp, for example a fluorescent lamp; or a multiple luminaire suitable for several tubular lamps. A multiple luminaire in general has a pair of side reflectors for each lamp.

DESCRIPTION OF THE PREFERRED EMBODIMENTS

Figure 1:
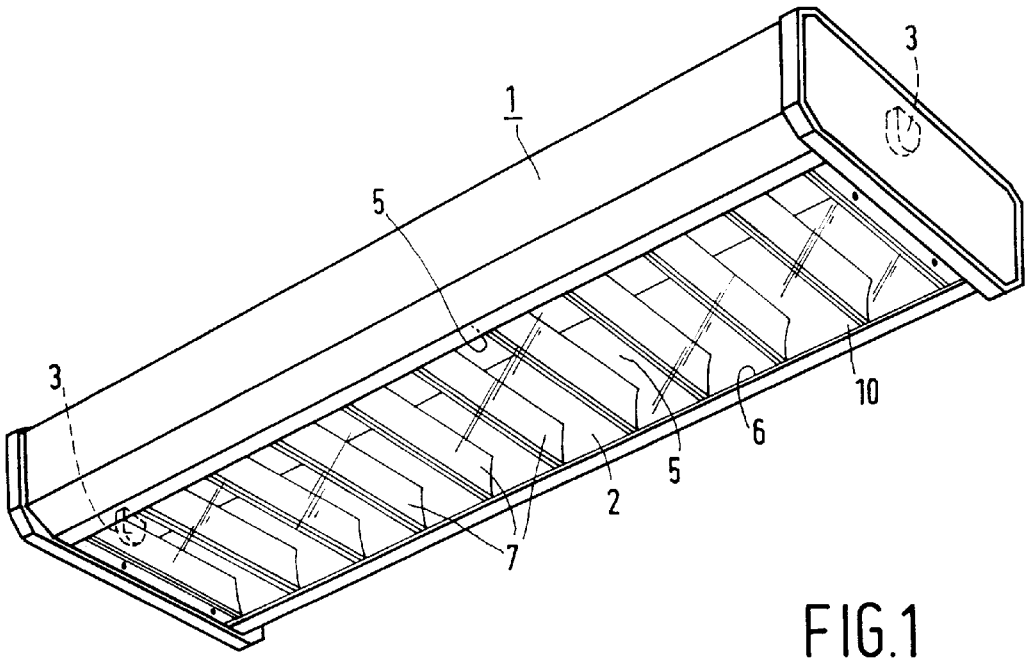
FIG. 1 shows a luminaire in perspective view.

In FIG. 1, the luminaire has a housing 1 with a light emission window defined by plane 2. Means 3 are present in the housing for accommodating a tubular lamp, here a linear low-pressure mercury discharge lamp, in the housing along the light emission plane. A pair of mutually facing side reflectors 5 each having an outer edge 6 in the light emission plane 2 and a plurality of lamellae 7 transversely arranged between the side reflectors 5 and transverse to the light emission window 2 is present in the housing.

A shaped synthetic resin sheet 10 having a base surface 11 and connected thereto a pair of mutually opposed raised walls 12 substantially closes off the light emission plane 2 with its base surface 11 while projecting with its raised walls 12 into the housing 1, keeping itself fixed there.

Figure 2:
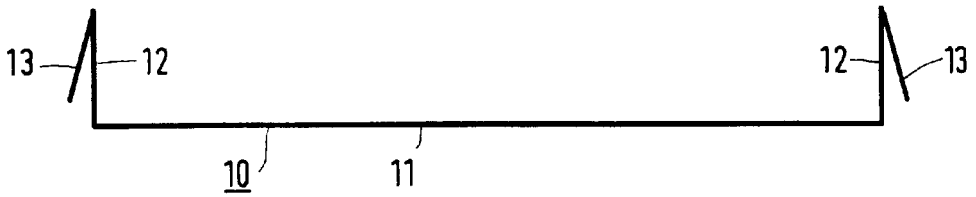
FIG. 2 shows the sheet of FIG. 1 in cross-section.

The shaped sheet 10 is at least substantially colorless and transparent. The raised walls 12 of the sheet each have a folded edge 13, see FIG. 2, which bears on the housing 1 with clamping force.

In the subsequent Figures, parts corresponding to those from the preceding Figures have the same reference numerals.

Figure 3:
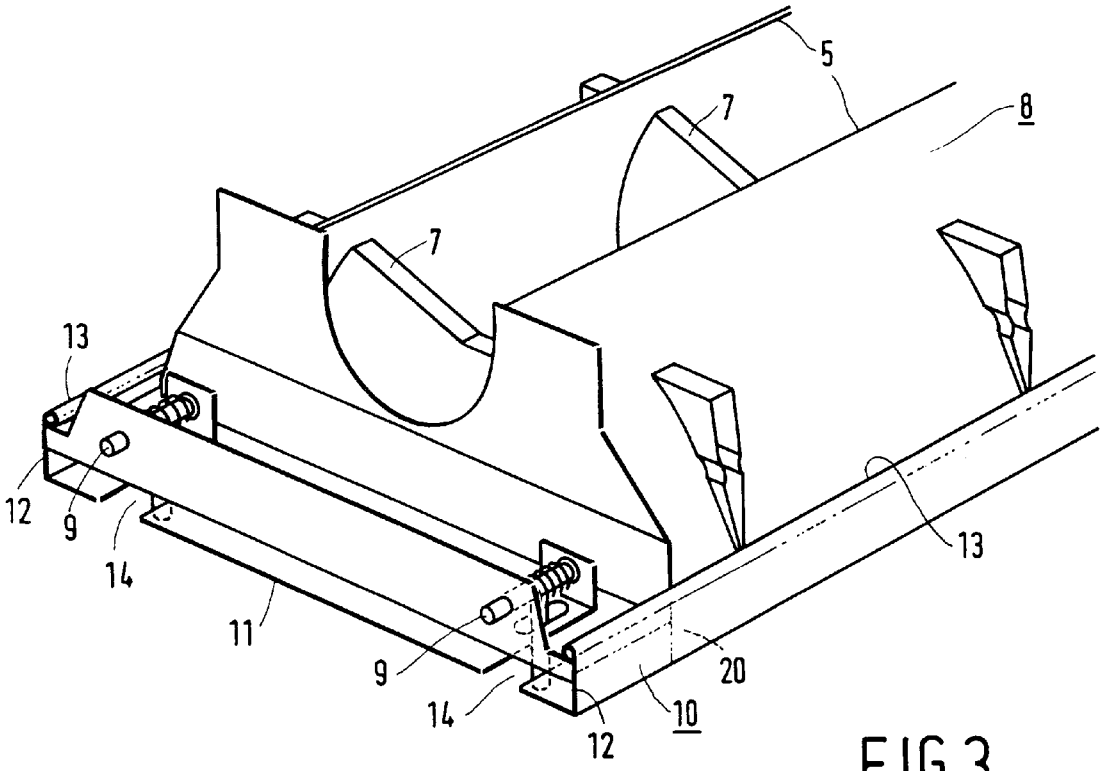
FIG. 3 shows a louver in perspective view.

In FIG. 3, the side reflectors 5 and the lamellae 7 form a detachable louver 8 which can be coupled to a housing 1 by retaining means 9. The shaped sheet is in engagement with the louver 8 by its raised walls 12. The sheet keeps the retaining means 9 accessible. For this purpose, the sheet has recesses 14 in its base surface 11 adjacent the retaining means in the embodiment drawn.

Figure 4:
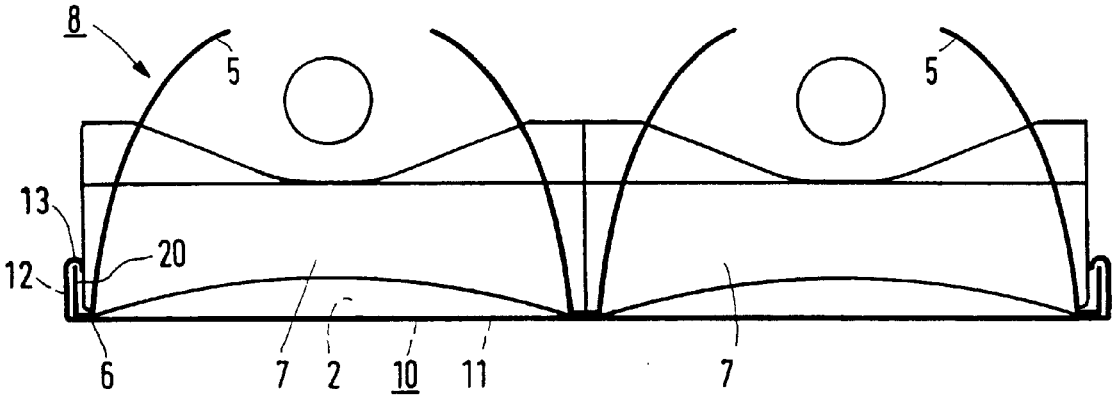
FIG. 4 shows a twin louver with sheet in cross-section.

The outer edges 6 of the side reflectors 5, see FIG. 4, each have a rim 20 bent back into the housing 1 when the relevant reflector is placed in that housing. The raised walls 12 of the shaped sheet 10 each have an edge 13 which is flanged inwards into a rounded shape, hooking around a corresponding rim 20. The edge 13 forms a full circle in the Figure. The stiffness of the edge may be enhanced in that it is made double-walled or extends even further inwards. Alternatively, the edge may form an incomplete circle.

The twin louver 8 of FIG. 4 also has a rim 20 at its outer edge 6 which is bent back into the housing in the situation in which the louver is mounted in the housing. The walls 12 of the foil 10 each have an edge 13 which is rounded inwards so as to hook around a corresponding rim 20. The sheet 10 clamps around the rims 20, and the open folds at the walls ensure that the sheet does not lose its grip on the louver 8. Since the rounded edge is open, it is easier now to pull the sheet from the louver 8 than in the case of the sheet of FIG. 3 with its closed rounded edge 13.

Figure 5:
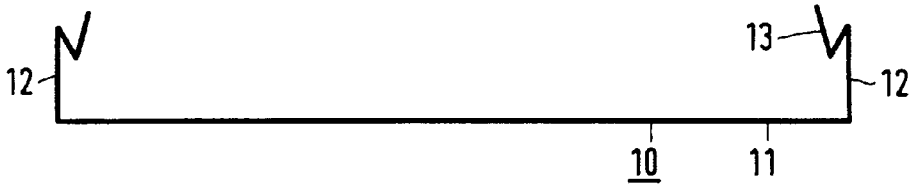
FIG. 5 shows another embodiment of the sheet in cross-section.

In FIG. 5, the edge 13 of the shaped sheet 10 is bent into a V-shape. As a result, the edge 13 can seat itself with clamping force between the rim 20 and the lamellae 7 projecting through the side reflector 6.

I claim:

1. A luminaire comprising:

a housing with a light emission plane;

means for accommodating a tubular lamp in the housing along the light emission plane;

a pair of mutually facing side reflectors in the housing, each having an outer edge in the light emission plane;

a plurality of lamellae arranged transversely between the side reflectors and transversely to the light emission plane, said lamellae and said reflectors forming a detachable louver in said housing, retaining means for detachably retaining said louver in said housing, and a shaped synthetic resin sheet having a base surface which substantially closes off the light emission plane and a pair of mutually opposed raised walls extending into the housing, said raised walls engaging said louver while keeping said retaining means accessible for detaching said louver from said housing.

2. A luminaire as claimed in claim 1 wherein each reflector has an outer edge with an outward facing rim bent back into the housing, and the raised walls each have an edge which is folded inwards and which hooks around a corresponding rim.

3. A luminaire as claimed in claim 2, characterized in that the folded edge is folded into a V-shape.

4. A luminaire as claimed in claim 1 wherein each reflector has an outer edge with an outward facing rim bent back into the housing, and the walls each have an edge which is flanged inwards into a rounded shape and which hooks around a corresponding rim.

5. A luminaire as claimed in claim 1, wherein shaped sheet is at least substantially colorless and transparent.

* * * * *